US009376804B2

(12) United States Patent
Ferren

(10) Patent No.: US 9,376,804 B2
(45) Date of Patent: Jun. 28, 2016

(54) MIRRORED INSULATING PANELS STRUCTURES, SYSTEMS AND ASSOCIATED PROCESSES

(71) Applicant: Applied Minds, LLC, Glendale, CA (US)

(72) Inventor: Bran Ferren, Beverly Hills, CA (US)

(73) Assignee: APPLIED MINDS, LLC, Burbank, CA (US)

( * ) Notice: Subject to any disclaimer, the term of this patent is extended or adjusted under 35 U.S.C. 154(b) by 0 days.

(21) Appl. No.: 14/716,261

(22) Filed: May 19, 2015

(65) Prior Publication Data

US 2015/0252564 A1 Sep. 10, 2015

Related U.S. Application Data

(63) Continuation of application No. 13/923,150, filed on Jun. 20, 2013, now Pat. No. 9,045,902.

(60) Provisional application No. 61/809,731, filed on Apr. 8, 2013.

(51) Int. Cl.

| | |
|---|---|
| ***E04B 1/74*** | (2006.01) |
| ***E04C 2/296*** | (2006.01) |
| ***E04B 1/88*** | (2006.01) |
| ***E04B 1/90*** | (2006.01) |
| ***E04B 1/84*** | (2006.01) |

(Continued)

(52) U.S. Cl.

CPC ..... *E04B 1/74* (2013.01); *E04B 1/8409* (2013.01); *E04B 1/88* (2013.01); *E04B 1/90* (2013.01); *E04C 2/296* (2013.01); *E04C 2/324* (2013.01); *E04B 2001/8414* (2013.01); *E04B 2001/8419* (2013.01); *E04C 2002/004* (2013.01); *E04C 2002/005* (2013.01)

(58) Field of Classification Search

CPC ..... E04B 1/74; E04B 1/76; E04B 1/7604; E04B 1/7662; E04B 1/88; E04B 1/90; E04B 1/8409; E04B 2001/8414; E04B 2001/8419

See application file for complete search history.

(56) References Cited

U.S. PATENT DOCUMENTS

| | | | | |
|---|---|---|---|---|
| 5,537,851 | A * | 7/1996 | Sheu | B21B 1/227 428/687 |
| 8,082,705 | B2 * | 12/2011 | Jaster | E04D 13/03 52/200 |
| 8,116,004 | B2 * | 2/2012 | Griffiths | E06B 9/28 359/591 |

(Continued)

OTHER PUBLICATIONS

"Meat and Food Processing and Storage Buildings Using Insulated Metal Panels", PermaTherm, Inc.; retrieved online on Dec. 21, 2012 from url: www.permatherm.net/metal-panel-systems/97-food-meat-processing, copyright 2011, 2 pages.

*Primary Examiner* — Andrew J Triggs

(74) *Attorney, Agent, or Firm* — Michael A. Glenn; Perkins Coie LLP

(57) ABSTRACT

Enhanced structural insulated panels, related processes, and related structures and systems provide several improvements over conventional structural panels. Some embodiments of the enhanced structural insulated panels comprise at least one exterior surface that is configured to provide a high degree of spectral reflectivity, such as comprising but not limited to a stainless steel or other material having a mirrored exterior surface. The outer surface may preferably be imparted with a series of waves, such as within a lay pattern, wherein the series of waves may preferably comprise varying wavelengths and wave heights.

20 Claims, 10 Drawing Sheets

(51) Int. Cl.
*E04C 2/32* (2006.01)
*E04C 2/00* (2006.01)

(56) References Cited

U.S. PATENT DOCUMENTS 8,745,938 B2 * 6/2014 Schuetz ..... E04D 13/033 52/200
9,045,902 B2 * 6/2015 Ferren ..... E04C 2/296
2009/0293395 A1 12/2009 Porter
2012/0272593 A1 * 11/2012 O'Neill ..... E04D 13/03 52/200
2014/0047784 A1 * 2/2014 O'Neill ..... E04D 13/03 52/200
2014/0298742 A1 * 10/2014 Ferren ..... E04C 2/296 52/404.1
2015/0252564 A1 * 9/2015 Ferren ..... E04C 2/296 52/316

* cited by examiner

MIRRORED INSULATING PANELS STRUCTURES, SYSTEMS AND ASSOCIATED PROCESSES

CROSS-REFERENCE TO RELATED APPLICATION(S)

This application is a continuation of U.S. Non-Provisional application Ser. No. 13/923,150, entitled "Mirrored Insulating Panel Structures, Systems, and Associated Processes," filed Jun. 20, 2013 which claims priority to U.S. Provisional Patent Application No. 61/809,731, entitled "Mirrored Structural Insulating Panel," filed Apr. 8, 2013, both of which are hereby incorporated in their entirety by reference for all purposes. This application is therefore entitled to a priority date of Apr. 8, 2013.

TECHNICAL FIELD

The present invention relates generally to the field of structural building panels and associated processes. More particularly, the present invention relates to insulated structural building panels, related structures and systems, as well as associated processes.

BACKGROUND

Structural building panels have long been used to facilitate modular construction of buildings. The use of structural building panels facilitates the rapid construction of buildings because these prefabricated panels reduce on-site construction time, while contributing a high level of precision to the overall building assembly. To increase thermal efficiency of structures constructed from structural building panels, while yielding structurally sound building systems, insulation may be incorporated within the building panels. The incorporation of insulation provides a structural insulated panel, or "SIP."

Conventional SIPs have a sandwich type structure that is comprised of two skin layers that are bonded to an inner core. For example, FIG. 1 is a schematic partial cross section of a conventional structural insulated panel (SIP) 10, comprising an insulative core 12 having opposing skins 14 and 18, respectively. Such conventional SIPs 10 are made from various materials to achieve specific performance criteria. Common SIP materials include cores 12 that are made from plastic foams such as expanded polystyrene, extruded polystyrene, and urethane foams. The outer skins 14 and/or 18 are typically made from oriented strand board, metal such as steel and aluminum, cement board, or other materials.

Due to cost, weight, and the desired properties, if a metal skin 14 or 18 is used, the thickness of the skin is generally 26 gauge (approximately 0.4826 millimeters or 0.019 inches) or thinner.

SIPs utilizing metal skins 14,18 can suffer from a number of cosmetic imperfections. One type of imperfection is commonly known as "oil canning" 20, which is a slight variation in the planar surface across the flat areas of structural insulated panels 10. Oil canning 20 is a naturally occurring phenomenon that is inherent in the use of sheet metal as a skin 14, 18, which arises during the manufacture of the sheet metal, and may increase during the manufacture and installation of the SIP 10. Indeed, SIP panel manufacturers, such as PermaTherm Inc., of Monticello, Ga., caution that no SIP 10 can be completely free of oil canning effects 20. This imperfection 20 can occur somewhat randomly and unpredictably throughout the skin surface. Oil canning 20 is typically considered to be an aesthetic issue, and not a structural problem or a defect. Generally, the imperfection 20 is so slight that it can only be detected by viewing the resulting distorted images that reflect off of the skin's surface. While only a slight physical defect, the resulting distorted reflection caused by oil canning 20 is often extremely unpleasant from an aesthetic perspective, as it causes carnival-mirror-like reflections.

Metal skinned SIPs 10 can also suffer from denting 24 or pitting 22. This damage can occur during the manufacturing or installation process, or during regular wear and tear. While these problems do not affect the strength or soundness of such SIPs 10, they often create unpleasant visual effects.

To overcome these otherwise unavoidable cosmetic defects, manufacturers often attempt to mask them, such as by creating a stucco-like embossed texture 30, i.e. actual embossing of the skin 14 and/or 18 itself, or by coating the skin surface with a non-reflective or dull finish 32, to decrease the specular reflectivity of the skin 14 and/or 18. These techniques achieve their goals, by preventing a clear reflected image from forming, thereby preventing a person from detecting the defects.

SIP panel manufacturers also discourage the use of high gloss or reflective surfaces, believing that they are more likely to show dust, fingerprints, and smudges. Instead, diffuse matte surfaces are advertised as being easier to clean, because they are more capable of obscuring these imperfections. For example, if unpainted stainless steel is used as a skin, it is normally brushed or sanded so that the surface produces a diffuse reflection.

It would be advantageous to provide structural insulated panels that provide improved optical characteristics for a wide variety of applications. Such structures, systems and/or processes would provide a substantial technical advance.

It would be further advantageous to provide a structural insulated panels that provide high gloss or reflective skins, without suffering from the cosmetic problems or distractions experienced in conventional SIPs. Such structures, systems and/or processes would provide an additional technical advance.

SUMMARY

SIPs with a mirrored surface are not currently available in the marketplace because conventional wisdom suggests that they would have unacceptable aesthetic defects.

Enhanced structural insulated panels, related processes, and related structures and systems provide several improvements over conventional structural panels. Some embodiments of the enhanced structural insulated panels comprise at least one exterior surface that is configured to provide a high degree of spectral reflectivity, such as comprising but not limited to a stainless steel or other material having a mirrored exterior surface. The outer surface may preferably be imparted with a series of waves, such as within a lay pattern, wherein the series of waves may preferably comprise varying wavelengths and wave heights.

BRIEF DESCRIPTION OF THE DRAWINGS

The present embodiments are illustrated by way of example and are not intended to be limited by the figures of the accompanying drawings. In the drawings.

DETAILED DESCRIPTION

Figure 1:
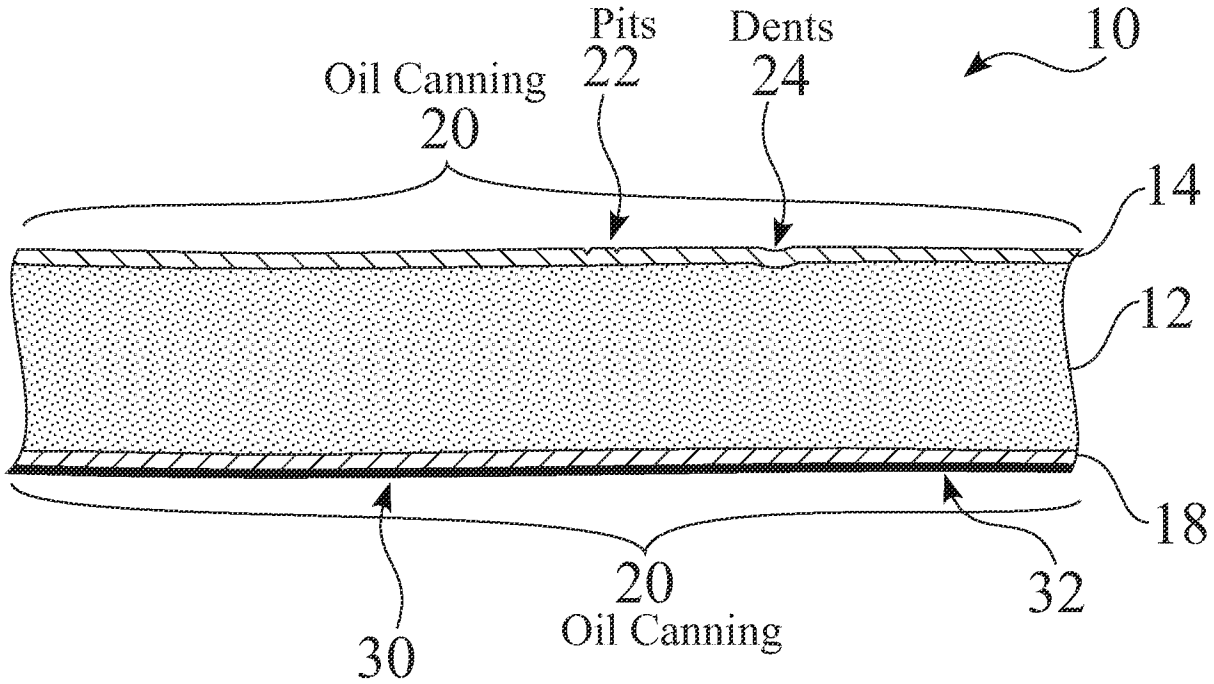
Fig. 1 (PRIOR ART)
FIG. 1 is a schematic partial cross section of a conventional structural insulated panel (SIP)

Conventional structural insulated panels, e.g. 10 (FIG. 1), avoid the use of smooth glossy surfaces, let alone mirrored or specular reflective surfaces. This is primarily because the industry is unable to produce optically flat structural panels. Given the large size of such structural insulated panels 10, e.g. often at least three or four feet across and several feet long, there is always some level of distortion inherent in the surface of the panels. This distortion results in a carnival mirror-like appearance in the reflected images that is aesthetically unpleasant.

Figure 2:
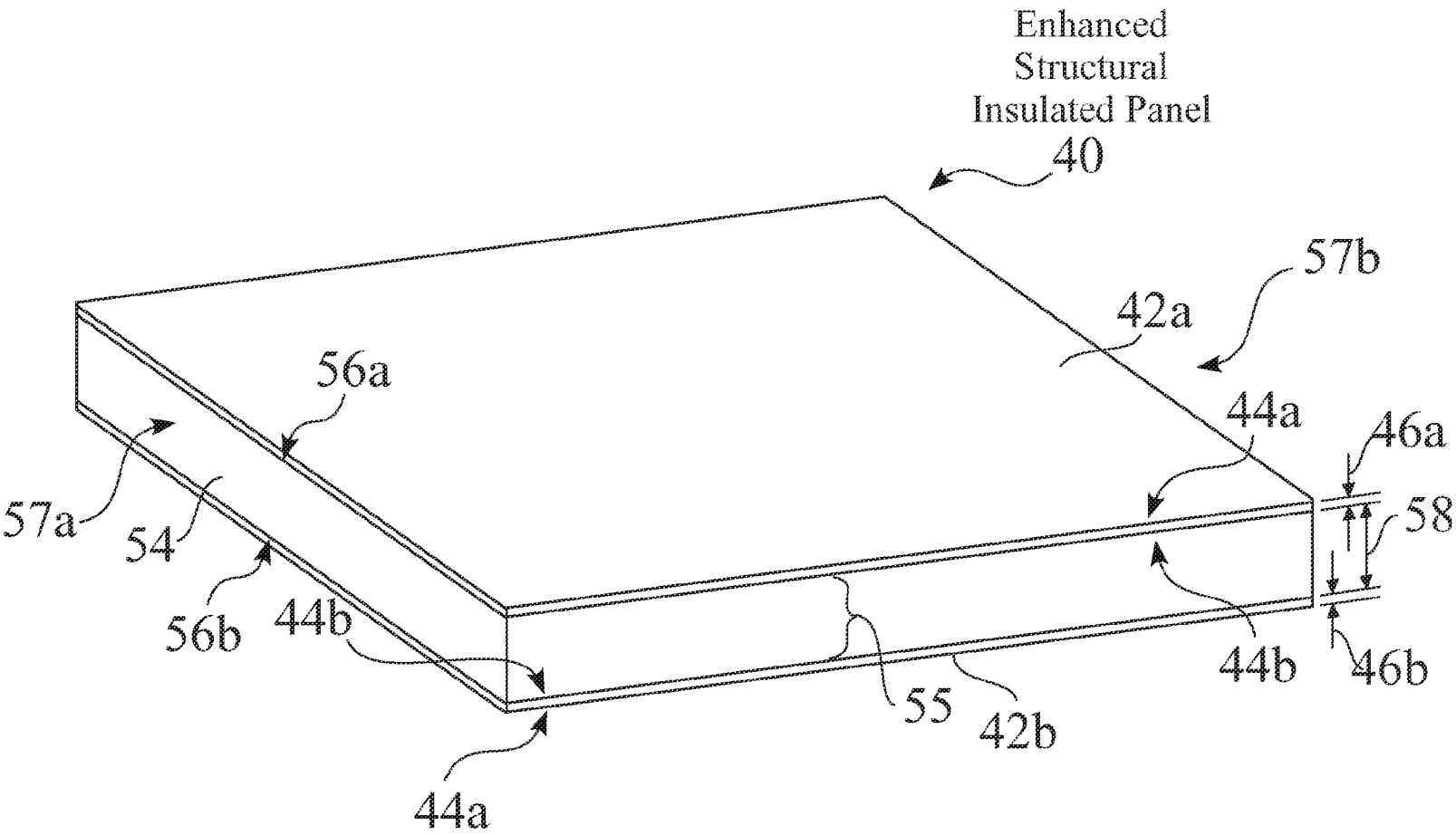
FIG. 2 is a partial cutaway view of an exemplary enhanced structural insulated panel (SIP) having a wavy mirror finish.

FIG. 2 is a partial cutaway view of an exemplary enhanced structural insulated panel (SIP) 40, which may comprise one or more enhancements, such as but not limited to having a wavy mirror finish on one or both outer panels 42, e.g. 42*a* and/or 42*b*. An inner core 54 typically comprises an insulative material, such as having an associated thickness 58 and opposing surfaces 56*a* and 56*b*.

Figure 6:
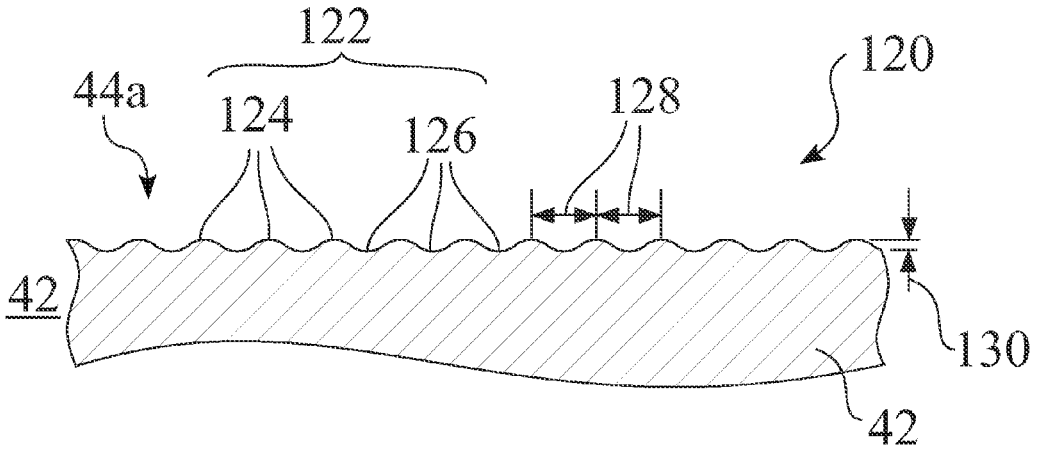
FIG. 6 is a partial cutaway view of an alternate exemplary outer layer for an enhanced structural insulated panel, wherein at least the outer surface of the layer comprises a series of waves.

The outer panels or skins 42, e.g. 42*a* and 42*b*, are located on the opposing surfaces 56*a*, 56*b* of the insulative core 54. Each of the outer panels 42 typically has a characteristic thickness 46, e.g. 46*a*,46*b*. As well, each of the outer panels 42, e.g. 42*a*, has an outer surface 44*a*, facing away from the structure 40, and an inner surface 44*b*, facing the inner core 54, such as at an associated core surface 56, e.g. 56*a* and/or 56*b*. One or both of the outer panels 42 may preferably comprise a highly reflective material, e.g. such as but not limited to stainless steel, wherein one or both of the outer surfaces 44*a* of the outer panels 42 may preferably be enhanced, e.g. such as having any of a polished surface, or surface features that are configured to provide specific optical properties. For example, as seen in FIG. 6, one or both of the outer surfaces 44*a* may comprise a series of waves 122 that, in combination with a highly reflective surface 44*a*, provides a reflective panel 40 that is also optically flat.

Figure 3:
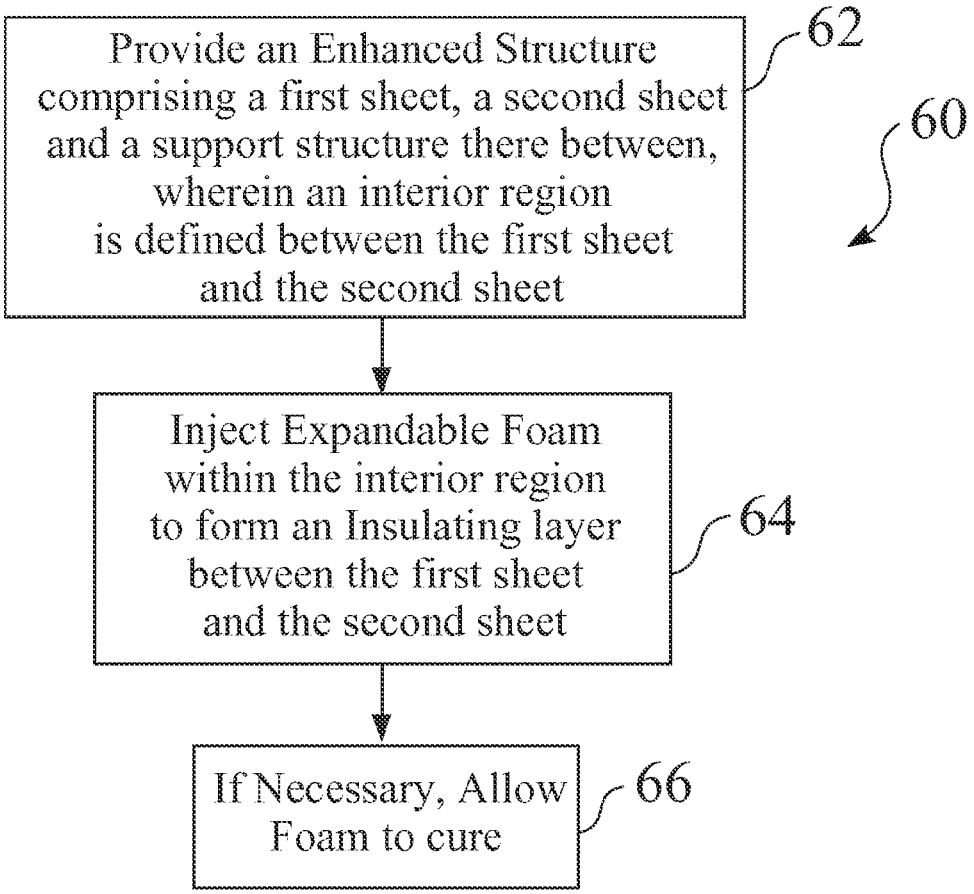
FIG. 3 is a flow chart of an exemplary process for forming an enhanced structural insulated panel.

FIG. 3 is a flow chart of an exemplary process 60 for forming an enhanced structural insulated panel 40, such as with an expanded or extruded insulative material 54 (FIG. 2). At step 62, an enhanced structure is provided, such as comprising a first outer panel 42, e.g. 42*a*, a second outer panel 42, e.g. 42*b*, and in some embodiments further comprising a support structure 106 (FIG. 5) there between, such as at opposing ends 57*a*, 57*b* (FIG. 2). In some embodiments, the support structure may comprise a plurality of spacers 106, e.g. longitudinally aligned spacers.

At step 64, foam 54 is injected or extruded into the interior region 55 (FIG. 2) that is defined between the outer panels 42*a*,42*b*. In some exemplary embodiments, the insulative material 54 comprises any of expanded polystyrene, extruded polystyrene, or urethane foam. If necessary, the insulative material 54 may be allowed to cure or harden, as indicated at step 66.

Figure 4:
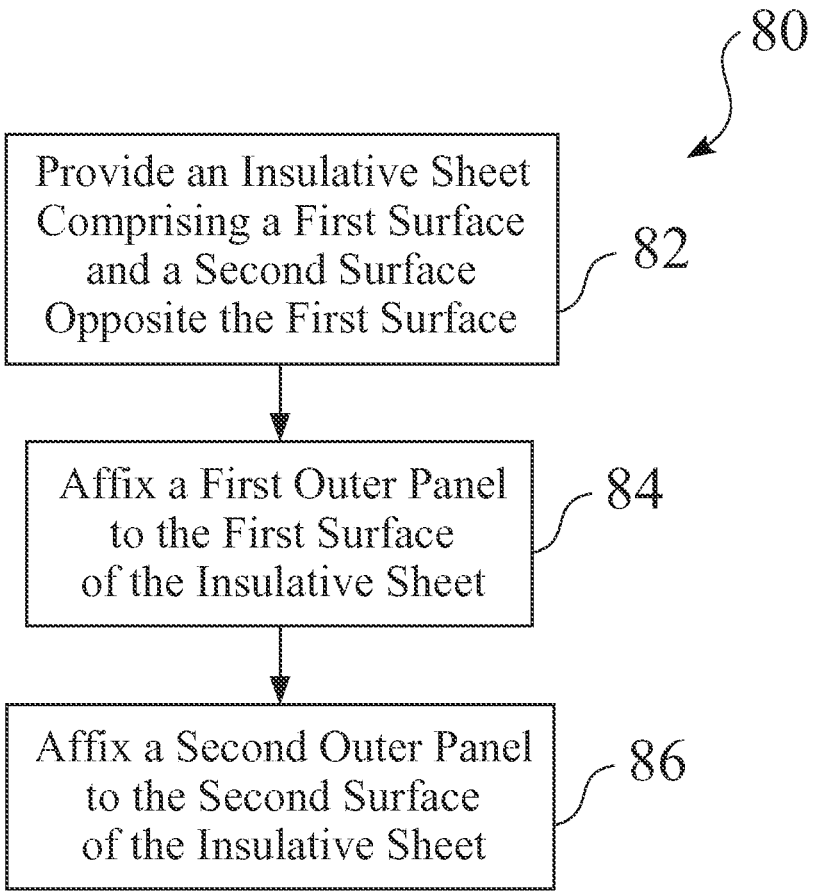
FIG. 4 is a flow chart of an alternate exemplary process for forming an enhanced structural insulated panel.

FIG. 4 is a flow chart of an alternate exemplary process 80 for forming an enhanced structural insulated panel 40, such as utilizing insulative material 54. At step 82, an insulative core, i.e. sheet 54 is provided, wherein the sheet 54 comprises a first surface 56*a*, and a second surface 56*b* opposite the first surface 56*a*. At step 84, the inner surface 44*b* of a first outer panel 42*a* is bonded or otherwise affixed to the first surface 56*a* of the insulative sheet 54. Similarly, at step 86, the inner surface 44*b* of a second outer panel 42*b* is bonded or otherwise affixed to the second surface 56*b* of the insulative material 54.

Figure 5:
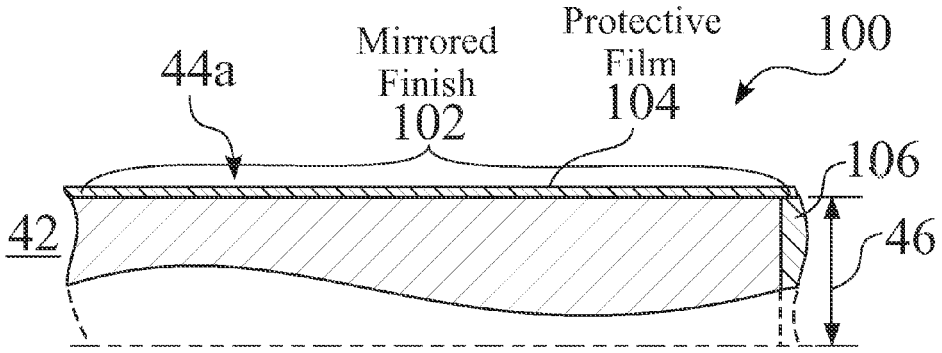
FIG. 5 is a partial cutaway view of an exemplary outer layer for an enhanced structural insulated panel.

FIG. 5 is a simplified partial cutaway view 100 of an exemplary outer panel 42 for an enhanced structural insulated panel 40, wherein the outer panel 42 typically comprises a characteristic thickness 46, e.g. 46 *a*, 46 *b* (FIG. 2). In some embodiments, the outer panel 42 (e.g. first outer panel 42*a* and second outer panel 42*b*) is between 0.35 and 0.60 millimeters thick. Some embodiments of the outer panels 42 may comprise a metal, such as but not limited to stainless steel, which may inherently provide or be polished to be highly reflective. The outer surface 44*a* of the exemplary outer panel 42 seen in FIG. 5 may preferably have a finish number of at least number 7, or in some cases, number 8. The outer panels 42 may preferably be polished before or after being integrated within an enhanced structural panel 40, and a protective layer 104, e.g. a polymer film, such as but not limited to a polyethylene film 104 may be applied to the outer surface 44 *a*, such as to protect the polished outer surface 44 *a* during any of fabrication, transportation, or installation.

FIG. 6 is a partial cutaway view 120 of an alternate exemplary outer panel 42 for an enhanced structural insulated panel 40, wherein at least the outer surface 44*a* of the outer panel 42 comprises a series of waves 122, such as comprising a plurality of longitudinally aligned convex peaks 124 and convex grooves or valleys 126, e.g. having a periodic spacing 128 and a wave height 130. In one current exemplary embodiment of the outer panel 42, e.g. 42*a*, the waves 122 have a wavelength spacing 128 of approximately 10 centimeters, i.e. about 4 inches, and a wave height 130 of approximately 0.01 millimeter, i.e. 0.00039 inches.

The wavelength 128 and wave height 130 may preferably be varied to create different effects. For example, depending on the surface characteristics of the outer panel 42 and the effect desired, the wavelength 128 of the waves 122 may preferably be between 1 and 100 centimeters, and the wave height 130 of the waves 122 may preferably be between 1 micrometer and 2 millimeters, wherein the crests 124 of the waves 122 are substantially parallel to each other.

As noted above, the outer surface 44*a* of at least one of the outer panels 42, e.g. 42*a*, may preferably be wavy, but not rough; rather, i.e. the exterior surface 44*a* may preferably be both wavy and smooth. Herein, rough and roughness, smooth and smoothness, and wavy and waviness are used as terms of art in characterizing surface finishes. Specifically, roughness (and smoothness) refers to the measurement of deviations, or lack thereof, from a perfectly planar surface at comparatively short spacings, i.e. at comparatively short wavelengths. Of particular interest are spacings that are comparable to the wavelengths of light within the visible spectrum. The smoothness of the outer surface 44*a* of an enhanced structural insulated panel 40 is such that the deviations at these spacings may preferably be reduced, to yield a desired specular surface finish.

Correspondingly, waviness refers to the measurement of deviations from a perfectly planar surface at comparatively distant spacings, i.e. at comparatively long wavelengths. Of particular interest are spacings that are comparable to the characteristic length of the oil canning distortions described above. For example, some embodiments of the enhanced structural insulated panel 40 may preferably introduce ripples 122, with a wavelength 128 that is substantially equal to or within one downward order of magnitude, e.g. such as but not limited to any of one half, one quarter, or one tenth, of an oil canning characteristic length, wherein the waves 122 may preferably be configured to mask the undesirable aesthetics of the oil canning effect.

Figure 7:
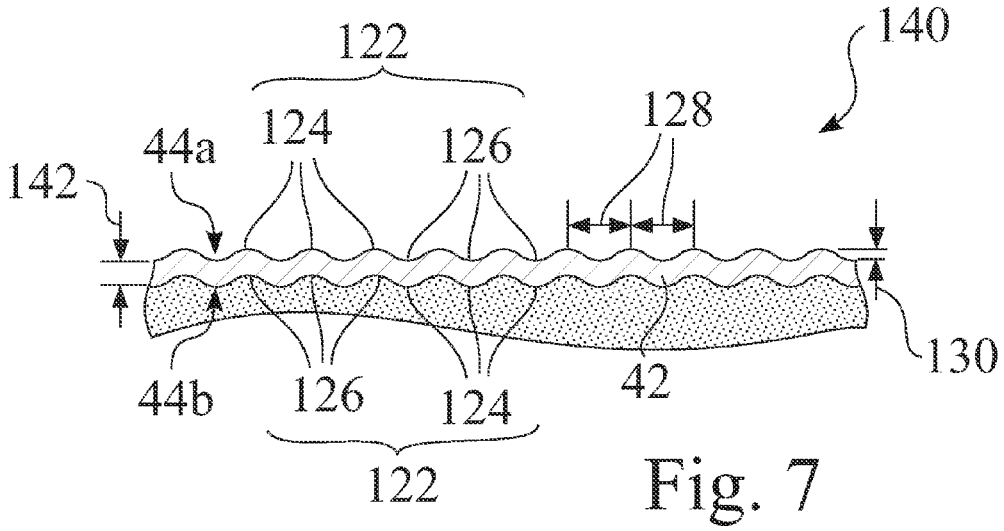
FIG. 7 is a partial cutaway view of an alternate exemplary outer layer for an enhanced structural insulated panel, wherein both the outer surface and the inner surface of the layer comprises a series of waves.

FIG. 7 is a partial cutaway view 140 of an alternate exemplary outer panel 42 for an enhanced structural insulated panel 40, wherein both the outer surface 44*a* and the inner surface 44*b* of the outer panel 42 comprises a series of waves 122, such as corresponding to a preformed outer panel 42 having a uniform thickness 142. As discussed above, the outer surface 44*a* may preferably comprise a spectrally reflective surface, e.g. a mirror surface, which may preferably be polished, such as before or after forming the waves 122. For example, the outer surface 44*a* of the exemplary outer panels 42 seen in FIG. 6 and FIG. 7 may preferably have a finish number of at least number 7, or in some cases, number 8.

Figure 8:
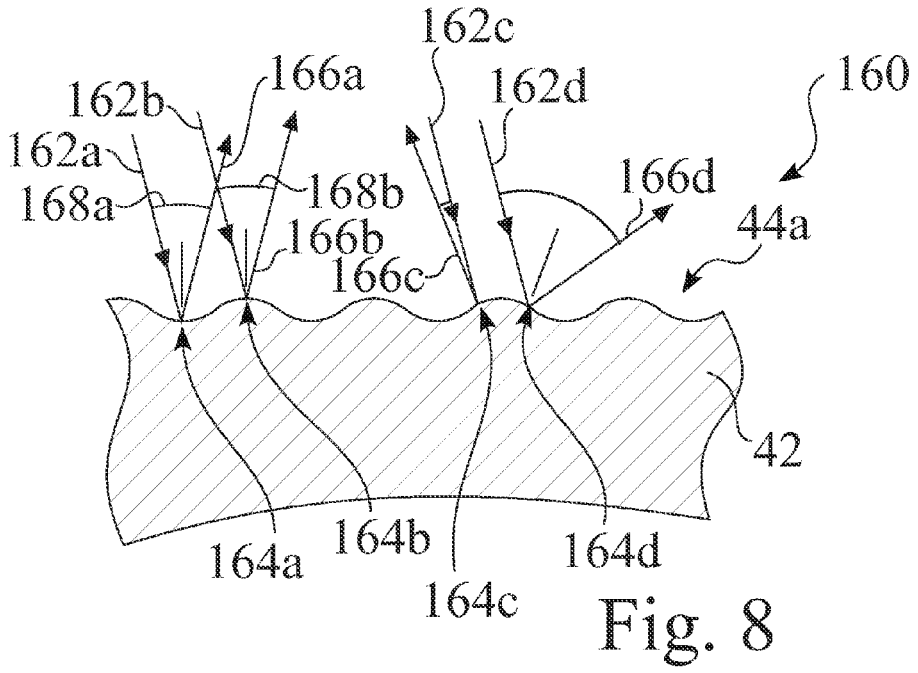
FIG. 8 provides a schematic view of spectral reflection on an outer panel surface having a plurality of waves.

FIG. 8 provides a schematic view 160 of spectral reflection on an outer panel surface 44*a* having a plurality of waves 122, e.g. a periodic sequence of longitudinally aligned waves 122, having a wave height 130, such as corresponding to the outer panels 42 seen in FIG. 6 or FIG. 7. As seen in FIG. 8, incident light 162, e.g. 162*a*-162*d*, may approach the outer surface 44*a* of a reflective outer panel 42, wherein the incident light 162 typically arrives at approximately the same angle of incidence.

As seen in FIG. 8, incident light 162*a* arrives 162 and is reflected at a wave bottom 126, which is substantially coplanar to the outer panel 42. The light is reflected at an angle 168*a*, and is transmitted 166*a*. Similarly, incident light 162*b* arrives and is reflected at a wave top 124, which is also substantially coplanar to the outer panel 42, wherein the light is reflected at an angle 168*b*, and is transmitted 166*b*. As also seen in FIG. 8, incident light 162*c* arrives and is reflected at leading edge of the wave surface 122, wherein the light is reflected at an angle 168*c*, and is transmitted 166*c*. As further seen in FIG. 8, incident light 162*d* arrives and is reflected at trailing edge of the wave surface 122, wherein the light is reflected at an angle 168*d*, and is transmitted 166*d*.

The exemplary spectral reflection of light 162 seen in FIG. 8 therefore illustrates the optical characteristics of an enhanced structural panel 40 having a wavy and reflective outer surface 44*a*, such that the reflective surface 44*a* provides unique spectral properties that may advantageously be implemented for a wide variety of applications.

Enhanced structural insulated panels 40 that include one or both wavy reflective outer surfaces 44*a* address many problems associated with conventional structural panels 10, wherein such intentionally wavy mirror finishes 44*a* may preferably be configured to obscure natural defects in the metal surface, e.g. oil canning, while simultaneously creating an aesthetically pleasing reflection. The waves 122 may preferably be configured to occur in a substantially parallel lay pattern, in which the waves 122 are aligned substantially parallel to each other, in a repetitive fashion. The wavelength 128, wave height 130, and orientation 184 (FIG. 9, FIG. 10) of the waves 122 may preferably be selected such that the resulting reflected image, while not reflecting perfect representations of nearby objects, reliably conveys the general nature of the panel's surroundings.

The enhanced structural insulated panels 40 seen in FIG. 6, FIG. 7, and FIG. 8 therefore may preferably provide a wavy mirror finish, wherein the enhanced structural insulated panels 40 comprise an interior panel 42, i.e. skin 42*b*, with an inner surface 44*b* and outer surface 44*a* opposite the inner surface 44*b*, an exterior panel 42, i.e. skin 42*a* with an inner surface 44*b* and outer surface 44*a* opposite the inner surface 44*b*, and a core 54. The inner surfaces 44*b* of the interior panel 42*b* and exterior panel 42*a* may preferably be affixed to the core 54.

While some exemplary embodiments of the enhanced structural insulated panel 40 have an exterior panel 42*a* comprises 26 gauge rolled 316 grade stainless steel, other alloys of stainless steel or other materials may preferably be used. As well, while the outer surface 44*a* of the exterior skin 42*a* may preferably be polished to a No. 8 or mirrored finish polish, other methods may preferably be used to achieve a specular finish.

Furthermore, as discussed above, a wavy mirror finish may preferably be applied to one or more panels 42 on an enhanced structural insulated panel 40, such as the exterior surfaces 44*a* on both the interior panel 42*b* and the exterior panel 42*a*. In some embodiments, while the outer surface 44*a* of one of the outer panels 42, e.g. 42*a*, may comprise a wavy specularly reflective surface, the opposite outer panel 42, e.g. 42*b*, may comprise a different surface, e.g. such as but not limited to a textured and/or painted non-reflective surface 44*a*.

The characteristics of the wavy mirror finish on one or more exterior surfaces 44*a* may preferably be configured to create different desired effects, such as by differing any of wave length 128 or the wave height 130 of the waves 122. These alterations may be based on the surroundings, or may be made to match other architectural aspects of the application.

The wavy mirror finish has many benefits. The distortions induced by the ripples 122 may preferably be configured to disguise and obscure manufacturing and installation defects that would otherwise cause undesirable aesthetic artifacts. The nature of these distortions, however, ensures that the mirrored panels nonetheless effectively reflect the general nature of a structure's surroundings. As well, for exterior applications, the wavy mirror finish helps birds and other wildlife to see the enhanced structural insulated panel 40, so as to avoid colliding with it.

Figure 9:
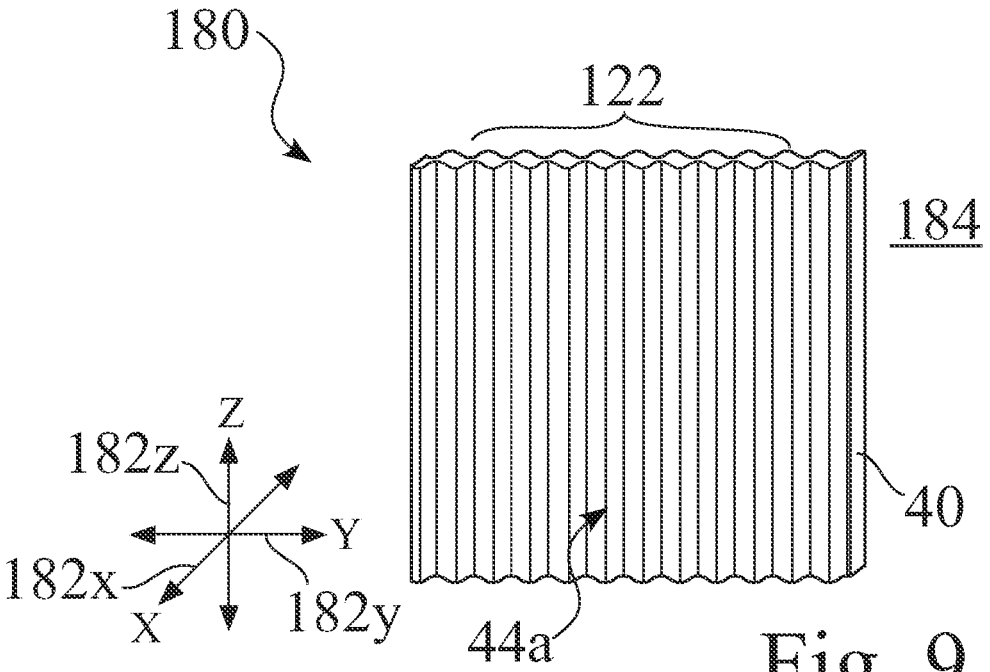
FIG. 9 is a detailed view of an enhanced structural panel having a series of waves defined on the outer surface of at least one of the panels, wherein the waves are generally aligned in a vertical direction.
Figure 10:
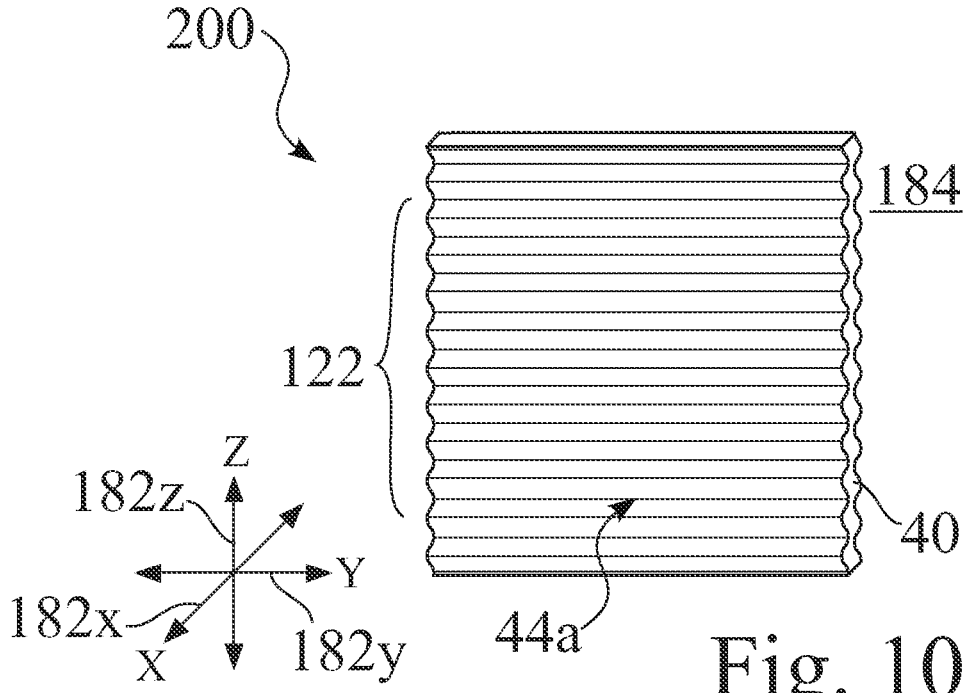
FIG. 10 is a detailed view of an enhanced structural panel having a series of waves defined on the outer surface of at least one of the panels, wherein the waves are generally aligned in a horizontal direction.

FIG. 9 is a detailed view 180 of an enhanced structural panel having a series 122 of waves defined on the outer surface 44 of an outer panel 42, wherein the waves are generally aligned in a vertical direction, such as generally aligned with a Z axis 182*z*. FIG. 10 is a detailed view 200 of an enhanced structural panel 40 having a series 122 of waves defined on the outer surface 44*a* of at least an outer panel 42, wherein the waves are generally aligned in a horizontal direction, such as generally aligned with a Y axis 182*y*.

While FIG. 9 and FIG. 10 illustrate exemplary vertical and horizontal orientations for an enhanced structural panel 40 that is mounted vertically, it should be understood that a wide variety of orientations and/or mounting options may preferably be chosen. For example, the outer panels 42 may preferably be oriented in any desired direction, such as in respect to any of an X axis 182*x*, a Y axis 182*y*, and/or a Z axis 182*x*. The desired orientation may preferably be based upon any of surrounding stationary or movable objects, stationary or movable viewers, the orientation of the enhanced structural panel 42, the orientation of objects associated with the structure 40, or any combination thereof.

Therefore, the waves 122 may preferably be oriented so that the crests 124 and valleys 126 run in any direction. The two most common directions are parallel to the horizon, i.e. vertical, such as seen in FIG. 9, or perpendicular to the horizon, i.e. horizontal, such as seen in FIG. 10.

The selection of the orientation of the waves 122 may preferably depend on the desired effect. For example, waves 122 in which the crests 124 run horizontally produce an image with little horizontal distortion but significant vertical distortion, wherein a horizon line may be reflected to a viewer from multiple (vertically offset) lines on the surface of the enhanced structural insulated panel 40. An individual placing a mirrored SIP panel 40 near a street may choose to orient the ripples in the horizontal direction, so that the reflection of cars passing by will only experience a low level of distortion.

Alternatively, waves 122 in which the crests 124 run vertically produce an image with little vertical distortion but significant horizontal distortion. An individual placing a mirrored SIP 40 panel near a wooded area with many tall trees T may choose to orient the ripples in the vertical direction so that the reflection of the tall trees Twill experience a low level of distortion. At the same time, a pedestrian walking past the building will perceive the speed of his reflection as alternating between fast and slow.

Figure 11:
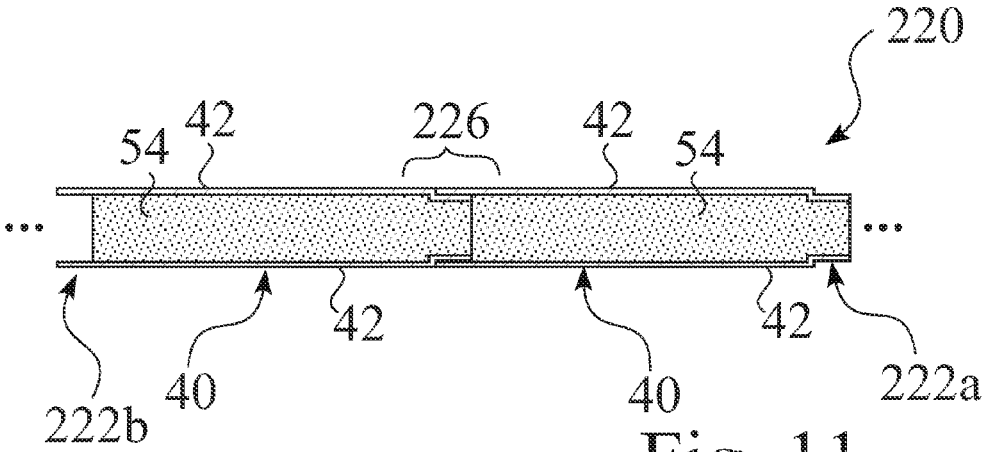
FIG. 11 shows a direct connection between two enhanced structural panels.

Enhanced structural insulated panels 40 may preferably be attached to other structural insulated panels 40, or to other objects, to form a wide variety of structures. For example, FIG. 11 is a schematic view 220 an exemplary direct connection 226 between two enhanced structural panels 40. Each of the enhanced structural panels 40 seen in FIG. 11 comprise a first edge 222*a* and a second edge 222*b* opposite the first edge 222*a*, wherein the first edge 222*a* of one of the enhanced structural panels 40 is configured to mate to the second edge 222*b* of a neighboring structural panel 40, e.g. such as to form an interlocking male and female connection 226. The connection may be further enhanced by other mechanisms, such as but not limited to an adhesive or one or more fasteners.

Figure 12:
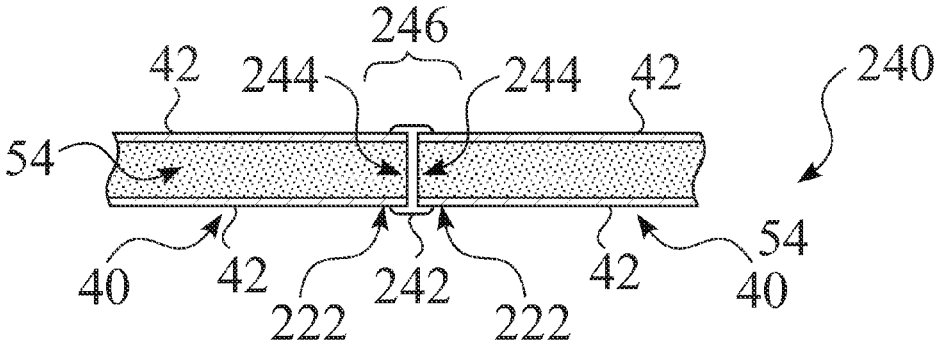
FIG. 12 shows an intermediate structural connection between two enhanced structural panels.

FIG. 12 is a schematic view 240 of an intermediate structural connection 246 between two enhanced structural panels 40. For example, a longitudinal edge 222 of a first enhanced structural panel 40 is configured to be affixed to a first receiving mechanism 244, e.g. a mating groove 244, of an intermediate connector 242, while a longitudinal edge 222 of a second enhanced structural panel 40 is configured to be affixed to a second receiving mechanism 244, e.g. a mating groove 244, of the intermediate connector 242, such as to form a connection 246 between the neighboring enhanced structural panels 40. The connections may be further enhanced by other mechanisms, such as but not limited to an adhesive or one or more fasteners.

Figure 13:
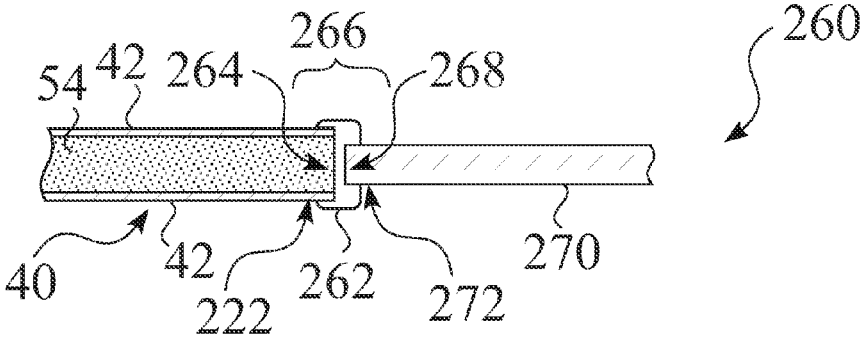
FIG. 13 shows an intermediate structural connection between an enhanced structural panel and another structure.

FIG. 13 is s schematic view 260 of an intermediate structural connection between an enhanced structural panel 40 and another structure 270, such as but not limited to any of glass, metal, wood, stone or concrete. For example, a longitudinal edge 222 of an enhanced structural panel 40 may preferably be configured to be affixed to a first receiving mechanism 264, e.g. a mating groove 264, of an intermediate connector 262, while a longitudinal edge 272 of a secondary structure 270 is configured to be affixed to a second receiving mechanism 268, e.g. a mating groove 268, of the intermediate connector 262, such as to form a connection 266 between the enhanced structural insulated panel 40 and the structure 270. The connections may be further enhanced by other mechanisms, such as but not limited to an adhesive, seals, gaskets, or one or more fasteners.

Figure 14:
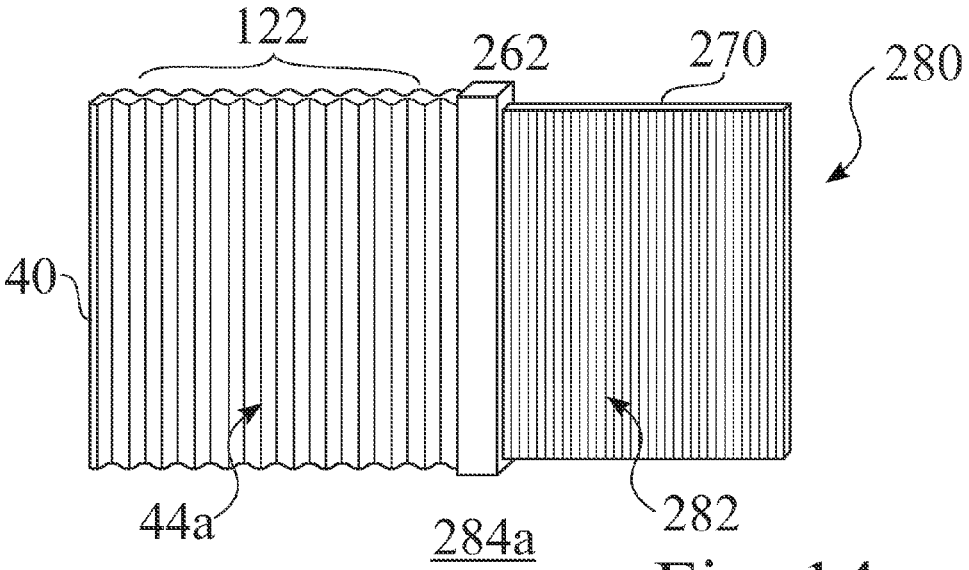
FIG. 14 shows a generally aligned relationship between the waves of a structural panel and the orientation of a second structure, e.g. window glass or a second enhanced structural panel.
Figure 15:
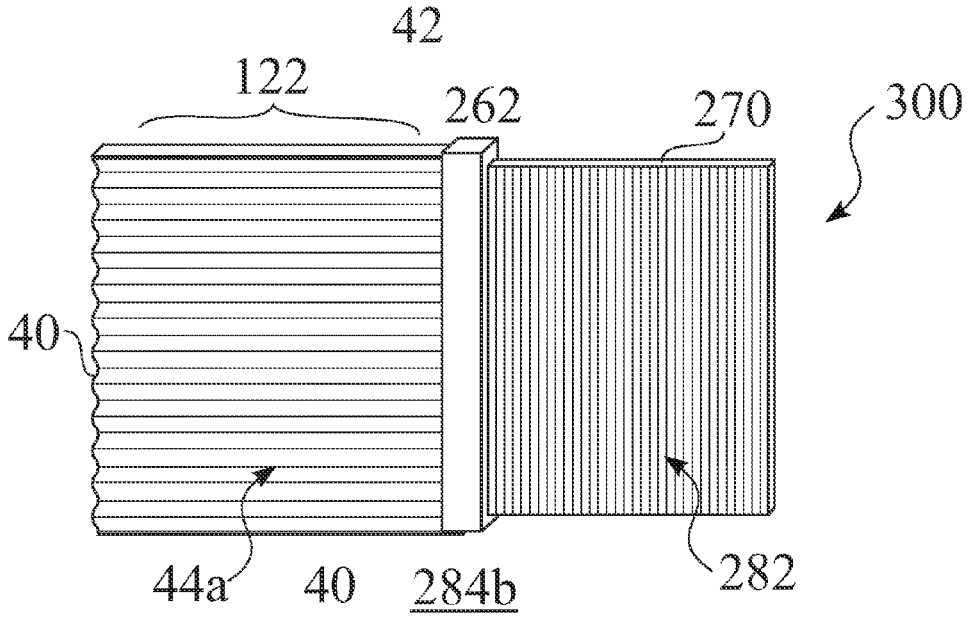
FIG. 15 shows a generally orthogonal relationship between the waves of a structural panel and the orientation of a second structure, e.g. window glass or a second enhanced structural panel.

Enhanced structural insulated panels may also preferably be aligned or skewed as desired. For example, FIG. 14 shows 280 a generally aligned relationship 284*a* between the waves 122 of an enhanced structural insulated panel 40 and the orientation of a second structure 270, e.g. window glass or a second enhanced structural panel 40. FIG. 15 shows 300 a generally orthogonal relationship 284*b* between the waves 122 of an enhanced structural insulated panel 40 and the orientation of a second structure 270, e.g. window glass or a second enhanced structural panel 40.

Tempered or strengthened glass 270 often exhibits a similar rippling effect 282, which is known as roller wave distortion. The orientation of the wave crests 124 of an enhanced structural panel 40 and the wave crests of the roller wave distortion 282 in the glass 270 may preferably be coordinated. For example, as seen in FIG. 14, the glass 270 and the enhanced structural insulated panel 40 may preferably be oriented such that the respective waves 122 and 282 are parallel to each other, as seen in FIG. 14, or perpendicular to each other, as shown in FIG. 15, depending on the desired effect. Additionally, the glass 270 and the enhanced structural insulated panel 40 may preferably be manufactured so that the wavelength 128 and height 130 of the waves 122 in the enhanced structural insulated panel 40 is consistent with that of the waves 282 in the neighboring structure 270.

Figure 16:
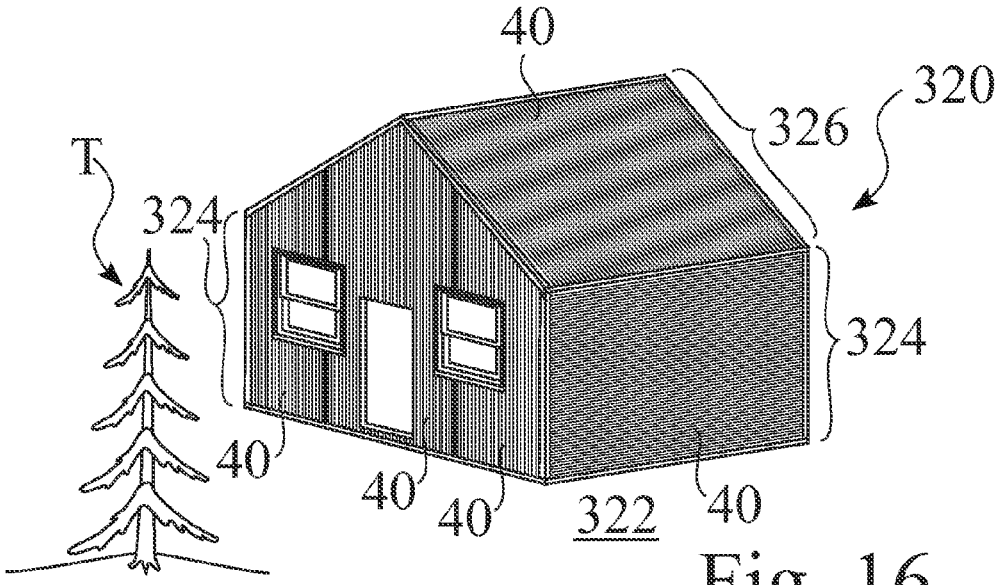
FIG. 16 is a schematic view of a stationary structure comprising one or more enhanced structural insulated panels.
Figure 17:
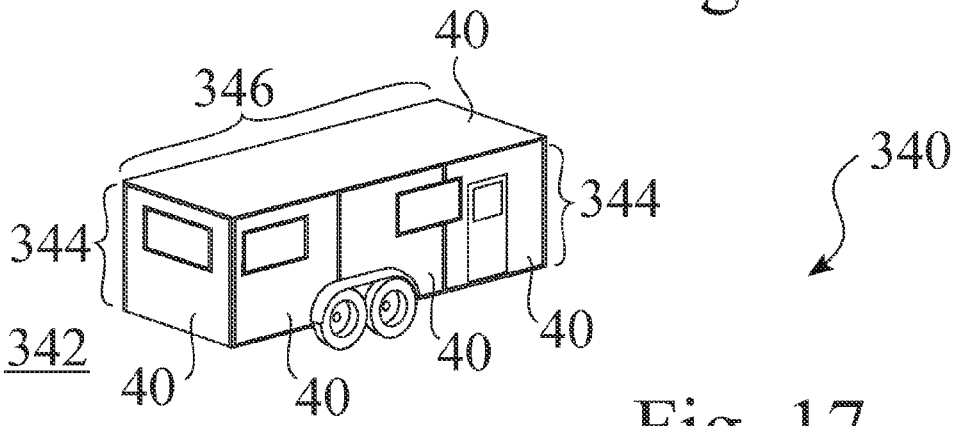
FIG. 17 is a schematic view of a stationary structure comprising one or more enhanced structural insulated panels.
Figure 18:
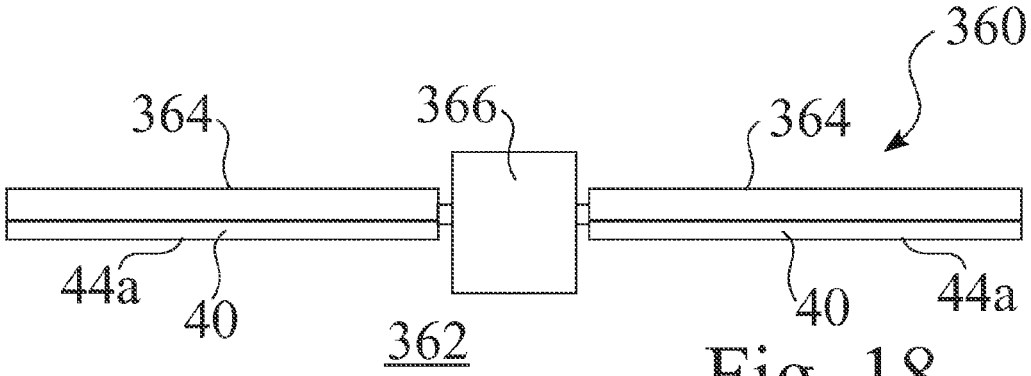
FIG. 18 is a schematic view of an enhanced structural integrated panel used in conjunction with other equipment, e.g. a solar panel, heat exchanger, such as for but not limited to earth or space applications.

The enhanced structural insulated panel 40 may readily be integrated within a wide variety of structures or systems. For example, FIG. 16 is a schematic view 320 of a stationary structure 322 comprising one or more enhanced structural insulated panels 40. FIG. 17 is a schematic view 340 of a mobile structure 342 comprising one or more enhanced structural insulated panels 40. FIG. 18 is a schematic view 360 of an engineering structure 362 comprising at least one enhanced structural integrated panel 40 used in conjunction with other equipment 364, e.g. such as but not limited to any of a solar panel or heat exchanger, such as for but not limited to earth or space applications.

As seen in FIG. 16, one or more enhanced structural insulated panels 40 may be used for one or more walls 324 of a structure 322, and may be used for other structures 326, e.g. roofing 326. As seen in FIG. 16, a plurality of enhanced structural insulated panels 40 are assembled to form a portion of a front exterior wall 324 for a structure 322, and may preferably be aligned with each other, in any desired orientation 184 (FIG. 9, FIG. 10). As well, one or more enhanced structural insulated panels 40 may preferably be assembled to form a portion of other walls 324 for a structure 322, and may be orientated 184 as desired. In addition, the exemplary enhanced structural insulated panels 40 used for a roofing structure 326 may typically be oriented as shown, to promote runoff for any of water, snow, leaves, dirt, dust, or pollen.

The above specification, examples and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the spirit or scope of this invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

All directional references, e.g. proximal, distal, upper, lower, upward, downward, left, right, lateral, front, back, top, bottom, above, below, vertical, horizontal, clockwise, and counterclockwise, are only used for identification purposes to aid the reader's understanding of the present invention, and do not create limitations, particularly as to the position, orientation, or use of the invention. Connection references, e.g. such as but not limited to attached, affixed, coupled, connected, and joined, are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

Accordingly, although the invention has been described in detail with reference to particular preferred embodiments, persons possessing ordinary skill in the art to which this invention pertains will appreciate that various modifications and enhancements may be made without departing from the spirit and scope of the claims that follow.

What is claimed is:

1. A process, comprising the steps of:

providing a structure comprising:

a first outer panel having an outer surface and an inner surface opposite the outer surface, and a second outer panel having an outer surface and an inner surface opposite the outer surface, wherein the first outer panel and the second outer panel are coplanar to each other and separated to define a region there between, and wherein the inner surface of the first outer panel faces the inner surface of the second outer panel; and providing an insulative layer within the region between the inner surface of the first outer panel and the inner surface of the second outer panel, wherein the insulative layer is affixed to the inner surface of the first outer panel and to the inner surface of the second outer panel;

wherein the outer surface of the first outer panel is specularly reflective;

wherein the outer surface of the first outer panel comprises a plurality of waves formed thereon; and wherein the plurality of waves have a wavelength between 1 and 100 centimeters.

2. The process of claim 1, wherein the plurality of waves have a wave height between 1 micrometer and 2 millimeters.

3. The process of claim 1, wherein the first outer panel is between 0.35 and 0.60 millimeters thick.

4. The process of claim 1, wherein the first outer panel comprises stainless steel.

5. The process of claim 4, wherein the stainless steel comprising the first outer panel comprises grade 316 stainless steel.

6. The process of claim 1, wherein the outer surface of the first outer panel comprises a polished surface having a finish number of at least 7.

7. A process, comprising the steps of:

providing a structure comprising:

a first outer panel having an outer surface and an inner surface opposite the outer surface, and a second outer panel having an outer surface and an inner surface opposite the outer surface, wherein the first outer panel and the second outer panel are coplanar to each other and separated to define a region there between, and wherein the inner surface of the first outer panel faces the inner surface of the second outer panel; and providing an insulative layer within the region between the inner surface of the first outer panel and the inner surface of the second outer panel, wherein the insulative layer is affixed to the inner surface of the first outer panel and to the inner surface of the second outer panel;

wherein the outer surface of the first outer panel is specularly reflective;

wherein the outer surface of the first outer panel comprises a plurality of waves formed thereon;

wherein the outer surface of the first outer panel exhibits a natural oil canning with a characteristic length and a characteristic height; and wherein the plurality of waves have a wavelength within one order of magnitude of the characteristic length of the natural oil canning.

8. The process of claim 7, wherein the plurality of waves have a wave height substantially equal to the characteristic height of the natural oil canning.

9. The process of claim 7, wherein the first outer panel is between 0.35 and 0.60 millimeters thick.

10. The process of claim 7, wherein the first outer panel comprises stainless steel.

11. The process of claim 10, wherein the stainless steel comprising the first outer panel includes grade 316 stainless steel.

12. The process of claim 7, wherein the outer surface of the first outer panel comprises a polished surface having a finish number of at least 7.

13. A process, comprising the steps of:

providing a structure comprising a first outer panel having an outer surface and an inner surface opposite the outer surface, and a second outer panel having an outer surface and an inner surface opposite the outer surface, wherein the first outer panel and the second outer panel are coplanar to each other and separated to define a region there between, and wherein the inner surface of the first outer panel faces the inner surface of the second outer panel; and providing an insulative layer within the region between the inner surface of the first outer panel and the inner surface of the second outer panel, wherein the insulative layer is affixed to the inner surface of the first outer panel and to the inner surface of the second outer panel;

wherein the outer surface of the first outer panel exhibits a natural oil canning with a characteristic length and characteristic height;

wherein the outer surface of the first outer panel comprises a plurality of waves formed thereon; and wherein the plurality of waves have a wavelength within one order of magnitude of the characteristic length of the natural oil canning.

14. The process of claim 13, wherein the outer surface of the first outer panel is specularly reflective.

15. The process of claim 13, wherein the plurality of waves are comprised of crests and valleys; and wherein the plurality of waves is oriented so that the crests and valleys are parallel to a horizon.

16. The process of claim 13, wherein the plurality of waves have a wave height substantially equal to the characteristic height of the natural oil canning.

17. The process of claim 13, wherein the first outer panel comprises stainless steel.

18. The process of claim 17, wherein the stainless steel comprising the first outer panel includes grade 316 stainless steel.

19. The process of claim 13, wherein the plurality of waves have a wave height between 1 micrometer and 2 millimeters.

20. The process of claim 13, wherein the first outer panel is between 0.35 and 0.60 millimeters thick.

* * * * *